US009725144B2

(12) United States Patent
Noras

(10) Patent No.: US 9,725,144 B2
(45) Date of Patent: Aug. 8, 2017

(54) SELF-PROPELLED CRAFT

(71) Applicant: Jorge Alberto Ferreira Noras, Torres Vedras (PT)

(72) Inventor: Jorge Alberto Ferreira Noras, Torres Vedras (PT)

(73) Assignee: Jorge Alberto Ferreira Noras, Torres Vedras (PT)

( * ) Notice: Subject to any disclaimer, the term of this patent is extended or adjusted under 35 U.S.C. 154(b) by 0 days.

(21) Appl. No.: 14/914,237

(22) PCT Filed: Sep. 1, 2014

(86) PCT No.: PCT/PT2014/000057

§ 371 (c)(1),
(2) Date: Feb. 24, 2016

(87) PCT Pub. No.: WO2015/034382

PCT Pub. Date: Mar. 12, 2015

(65) Prior Publication Data

US 2016/0214692 A1 Jul. 28, 2016

(30) Foreign Application Priority Data

Sep. 3, 2013 (PT) ..... 107141

(51) Int. Cl.
*B63C 9/08* (2006.01)
*B63B 35/79* (2006.01)
(Continued)

(52) U.S. Cl.
CPC ..... *B63C 9/082* (2013.01); *B63B 35/7943* (2013.01); *B63C 11/46* (2013.01);
(Continued)

(58) Field of Classification Search
CPC B63C 11/46; B63C 9/08; B63C 9/082; B63B 35/73; A63B 35/00; A63B 35/12; B63H 11/00; B63H 11/08
(Continued)

(56) References Cited

U.S. PATENT DOCUMENTS 2,722,021 A * 11/1955 Keogh-Dwyer ..... A63B 35/12 114/315
3,329,118 A * 7/1967 Strader ..... A63B 35/12 114/315
(Continued)

FOREIGN PATENT DOCUMENTS

WO 2012/139044 A1 10/2012

OTHER PUBLICATIONS

International Search Report and Written Opinion for PCT/PT2014/000057, mailed Dec. 15, 2014 (7 pages).

*Primary Examiner* — Lars A Olson
(74) *Attorney, Agent, or Firm* — Nutter McClennen & Fish LLP; John J. Penny, Jr.

(57) ABSTRACT

The present invention comprises a self-propelled craft with a U-shaped main body provided with two turbines, one on each flap of the U-shaped main body, which propel the self-propelled craft through turbine operation in a chamber fed by water received by water intakes which is ejected by the ejection openings, and which turbines move inside the turbine operation chamber adopting automatically one of two possible positions due to the casing which is placed in two different positions within the turbine operation chamber, which positioning results from the placement of the device on the water being done by side A or B, the water intake being done through existing water entrances on side A or B of the device.

10 Claims, 6 Drawing Sheets

(51) Int. Cl.

| | |
|---|---|
| ***B63C 11/46*** | (2006.01) |
| ***B63H 11/10*** | (2006.01) |
| ***B63H 11/08*** | (2006.01) |
| *B63H 23/24* | (2006.01) |
| *B63B 35/78* | (2006.01) |
| *B63C 9/00* | (2006.01) |

(52) U.S. Cl.
CPC ..... *B63H 11/08* (2013.01); *B63H 11/10* (2013.01); *B63B 35/78* (2013.01); *B63C 2009/0017* (2013.01); *B63H 23/24* (2013.01)

(58) Field of Classification Search
USPC ..... 440/1, 38; 114/315
See application file for complete search history.

(56) References Cited

U.S. PATENT DOCUMENTS

| | | | |
|---|---|---|---|
| 3,721,208 | A | 3/1973 | Lampert et al. |
| 5,145,426 | A | 9/1992 | Kobayashi et al. |
| 6,461,204 | B1 | 10/2002 | Takura et al. |

* cited by examiner

SELF-PROPELLED CRAFT

Priority is claimed under 35 U.S.C. §119 to Portuguese Application No. 107141 filed on Sep. 3, 2013 and under 35 U.S.C. §365 to PCT/PT2014/000057 filed on Sep. 1, 2014.

TECHNICAL FIELD OF THE INVENTION

The present invention relates to the area of search and rescue equipment at sea, remotely controlled and applicable to all situations of shipwrecked people rescue, able to be used from land, sea and air.

The present invention may also be included in the recreational nautical equipment.

STATE OF THE ART

Various search and rescue equipment at sea are known from the prior art, which however present several limitations in what concerns the format itself, the mobility and the navigational capabilities in adverse conditions.

Document WO 2012139044 A1 discloses a buoy with a motor comprising a hull, a floating device coupled to the hull that is configured to maintain the buoy in an upright position, a motor embedded in the hull and a mechanism activated by remote control device. However, this device, considered the most representative of the state of the art, can only navigate in the position in which it is placed on the water.

The present invention solves the technical problem of being able to navigate in all conditions, regardless of how it is placed or thrown into the water, or when it turns upside down. Basically, the device can navigate on any of its sides by automatically switching the water inlets.

SUMMARY OF THE INVENTION

The present invention relates to a U-shaped self-propelled craft directly and remotely controlled, running through two turbines and respective motors that allow navigation on any of the sides.

The manoeuvrability achieved with the present vehicle features an extraordinary performance, and even in the most demanding sea conditions the behaviour and control of the self-propelled vehicle show to be very effective. This is achieved by the high power propulsion system and turbine operation system of the invention.

Experiments in those sea conditions show that the rescue of shipwrecked people is facilitated, either because the device arrives very quickly to the place of the shipwreck, or because the remote control is reliable and robust.

The vehicle can be used both on beaches, as auxiliary equipment of lifeguards, and on board ships, interacting with a safety device that automatically releases the vehicle when someone falls overboard and allowing it to be guided by the electronic control module to the place where the person to be rescued is, or even on unsupervised or remotely supervised beaches, in this case being in stand-by on a support platform automatically released into the water by an electronic alarm.

Additional advantages of the invention are:

- quick aid to the shipwrecked person;
- ease of use, by both the rescuer and the shipwrecked person;
- navigation capability in adverse sea conditions;
- reduced dimensions that facilitate the storage on land, sea or air means, and consequent versatility of use;
- usage as recreational nautical equipment.

Another feature of the device is its "U" shape, which facilitates the navigation and the entry of the shipwrecked person, thus replacing the traditional circular "lifebuoy". The shape design allows it to navigate on rough seas and waters, reaching rapidly the shipwrecked person and being able to be launched from land, from ships or aircrafts.

Equipped with full mobility, the device can quickly reach the shipwrecked person and will be able to bring him/her to shore or to the nearest support point. To achieve these features it was developed starting from the basic concept intended to be replaced, the static buoy, now provided with propulsion. The final form reached is the one that best meets the requirements: ease of use, both by the lifeguard and by the shipwrecked person; navigation capability in difficult sea conditions; reduced dimensions that facilitate its storage on vessels; versatility of use, whether used from land, with or without a lifeguard, or from a vessel or an aircraft, and also as a recreational vehicle.

One of the great difficulties of a shipwrecked person is to put himself on the circular buoy, a situation that is totally overcome with this device.

This vehicle has an electronic module for navigation and orientation. The electronic module is placed on the front and inside the device. It consists of a magnetometer, an accelerometer and a gyroscopes, a GPS, a system of audio/video and a traction control which is activated in critical situations at sea and which provides a more balanced propulsion of the turbines.

The self-propelled craft may also include a surveillance/tracking optical system, consisting of cameras and software that detects requests for assistance through movements performed by the shipwrecked person warning the lifeguard, or it may be released to water automatically.

The present invention is designed to provide assistance to persons in situations of drowning in seas, rivers and lakes, and for recreational use.

The remote control was integrated into a small, robust and completely waterproof equipment, intended for ease utilization in one hand, by any person. It is provided with a telemetry system that controls the batteries level and that can be monitored in the command itself through visual and audible indication.

The device can be recharged directly on a mains plug or by induction. The slow and/or maintenance charging is done by induction, while rapid charging is done by direct connection. The charging will be made through a solar panel or other alternative energy sources integrated in the holder where the device is.

LEGEND

Figure 1:
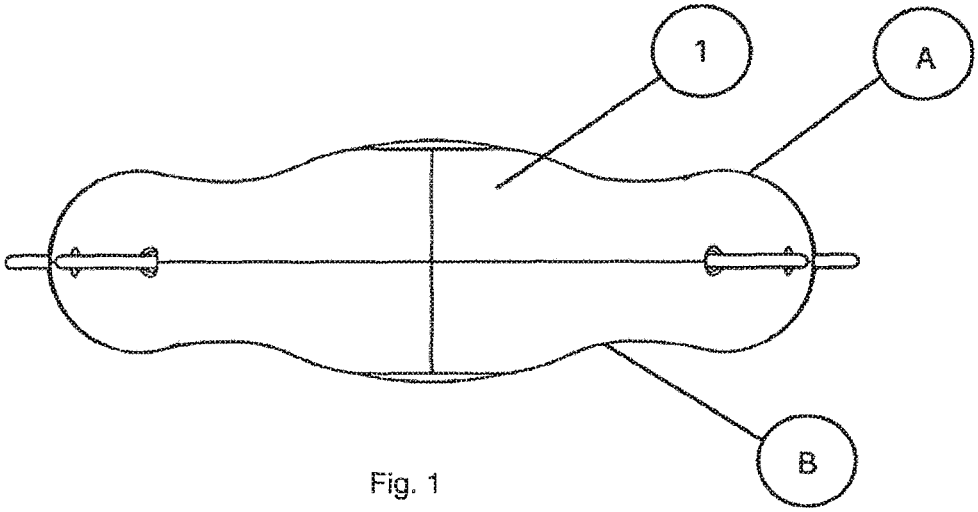
FIG. 1 is a front view of the self-propelled craft.
Figure 2:
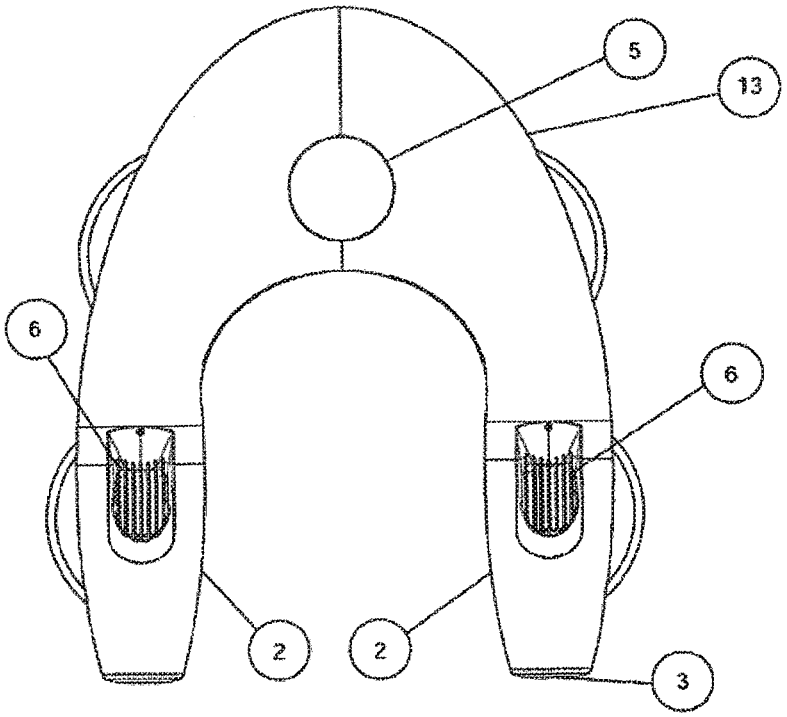
FIG. 2 shows a self-propelled craft.
Figure 3:
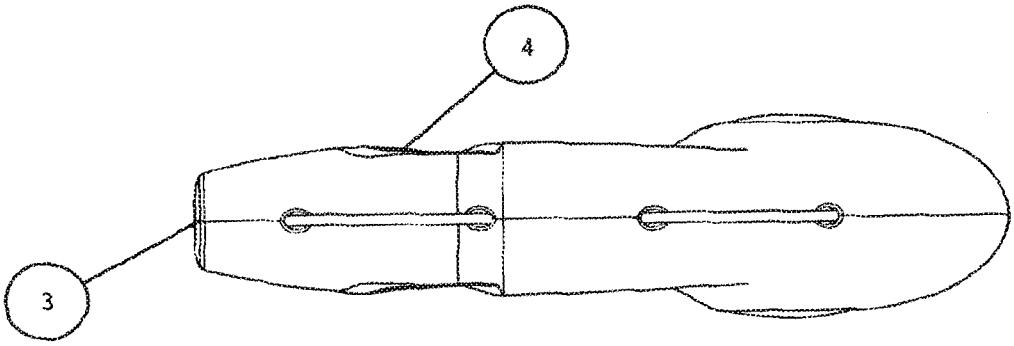
FIG. 3 is a side view of the self-propelled craft.
Figure 4:
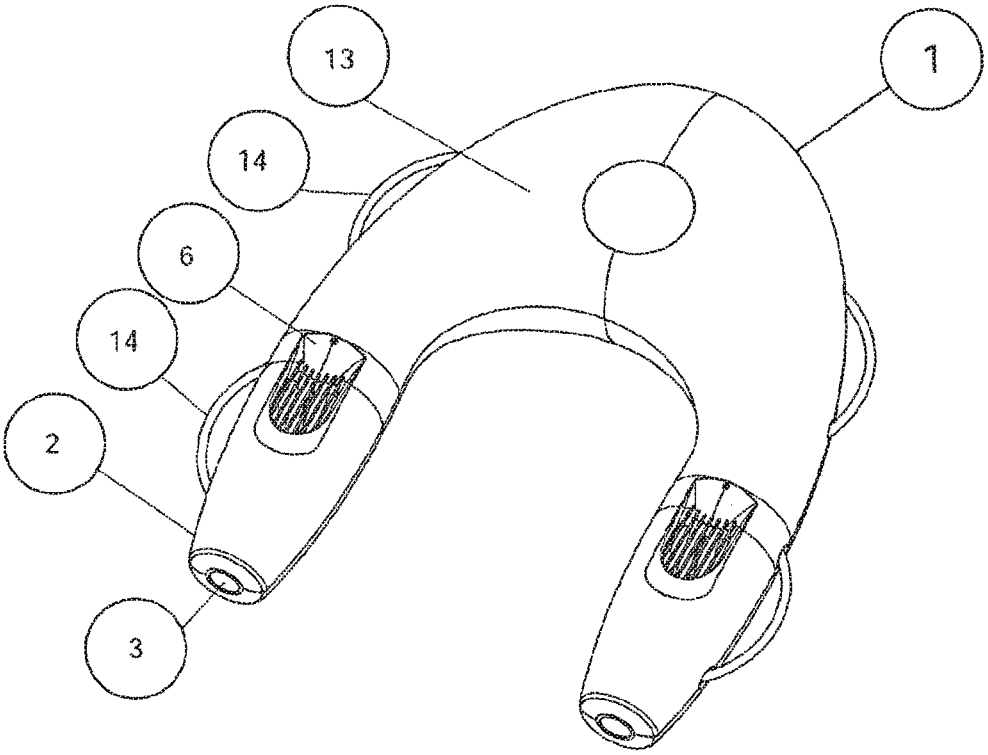
FIG. 4 is a perspective view of the self-propelled craft.
Figure 5:
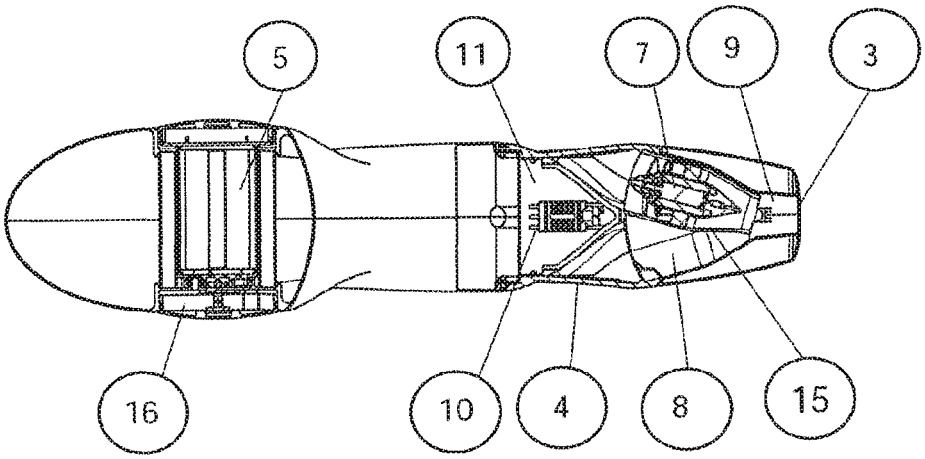
FIG. 5 is a side section view of the self-propelled craft.
Figure 6:
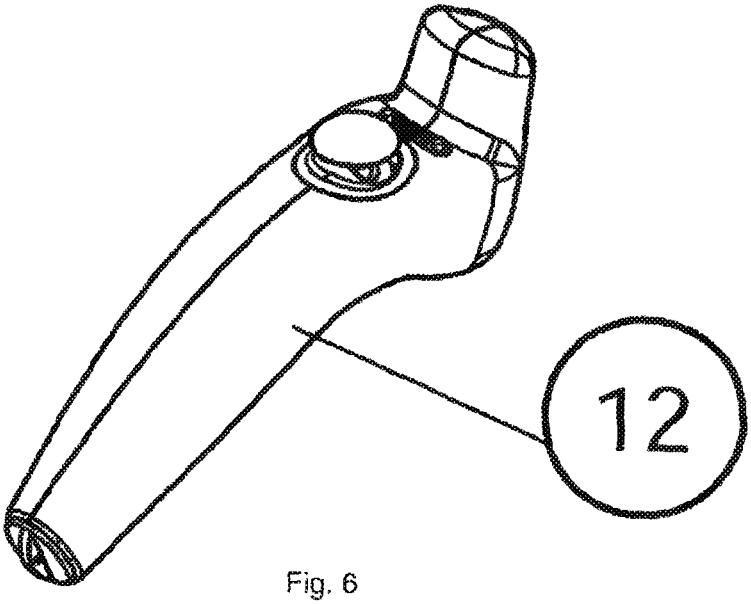
FIG. 6 is perspective view of the remote control device of the self-propelled craft.

1—Self-propelled craft
2—Device flaps
3—Ejection openings
4—Water inlet
5—Battery
6—Grid

7—Turbine
8—Turbine operation chamber
9—Ejection/propulsion chamber
10—Drives
11—Drives housing chamber
12—Remote control device
13—Device central body
14—Handles
15—Turbine casing
16—Electronic Control Module

DETAILED DESCRIPTION OF THE INVENTION

The present invention comprises a self-propelled craft with a U-shaped main body provided with two turbines (7), one on each flap (2) of the U-shaped main body, which propel the self-propelled craft (1) through turbine operation in a chamber (8), fed by water received by water intakes (4) that is ejected by the ejection openings (3), and which turbines (7) move inside the turbine operation chamber (8) adopting automatically one of two possible positions due to the casing (15) which is placed in two different positions within the turbine operation chamber (8), which positioning results from the placement of the device on the water being done by side A or B, the water intake being done through existing water entrances (4) on side A or B of the device.

The casing (15) can be a part with the inner shape of the turbine operation chamber (8) that allows an easy sliding of the turbine (7), or it may be the interior of the turbine operation chamber (8) itself, as long as it has the necessary surface finish for an easy sliding of the turbine (8).

The self-propelled craft also comprises a battery (5), an electronic control module (16) and drives (10).

The drives (10) are of the speed drive type, providing a smooth operation of the turbines (7), avoiding power surges that would increase the batteries consumption and allowing for easier manoeuvrability of the craft.

The self-propelled craft communicates with a communication device at a distance (12), which allows controlling of said vehicle.

Beyond the self-propelled craft and the distance communication device, the system further includes a seating platform and a charging platform for the craft and device.

In a preferred embodiment of the invention, the self-propelled craft has handles (14) on the flaps to facilitate rescue.

In a preferred embodiment of the invention, the self-propelled craft comprises a sonar.

In a preferred embodiment of the invention, the self-propelled craft includes a GPS.

In a preferred embodiment of the invention, the self-propelled craft includes cameras sending a signal to a central.

In a preferred embodiment of the invention the drives (10) feeding the turbines are in contact with turbine operation chamber (8).

In a preferred embodiment of the invention, the battery is powered by direct connection or induction and further by solar panel or other alternative energy equipment.

In a preferred embodiment of the invention, the self-propelled craft is made of composite materials.

In a preferred embodiment of the invention, the self-propelled craft is made of inflatable material.

In a preferred embodiment of the invention, the electronic control module is linked to a mechanical element having two possible positions: one that locks the self-propelled craft when the craft is coupled to a support, and another in which it releases the self-propelled craft in a situation of electronic surveillance.

In a preferred embodiment of the invention, the self-propelled craft, when in hibernation or standby, can be activated by any movement or information from the remote control.

In a preferred embodiment of the invention, the self-propelled craft when in hibernation or standby can be activated automatically by a signal sent by a device that is coupled to a crewmember or embedded in a suit or uniform. This device would preferably work as follows: in the event of a crew or any person in possession of this device falls overboard, this device, through direct contact with water, automatically sends a signal to drive the self-propelled craft. The self-propelled craft is then automatically released into the water heading automatically to the point where the device is located and allowing automatic rescue of the shipwrecked person.

In a preferred embodiment of the invention, the self-propelled craft includes a power controller of the turbines and telemetry indicating the battery level or, through an application on a smartphone, allowing a diagnosis of possible malfunctions, a consultation of the charging cycles history and a monitoring of all telemetry functions.

In addition to the self-rescue device, the system includes seating and charging platform of the self-propelled craft that has electric charging sources of the self-propelled craft when at rest.

The invention claimed is:

1. A self-propelled craft with a U-shaped main body, said U-shaped main body having two flaps, two turbines, one on each flap, a casing which allows two different positions of the turbines within a turbine operation chamber by the casing being placed in two different positions within the turbine operation chamber, said positioning of the casing being determined by a side on which the craft is placed on water, wherein water intake is done through existing water entrances on either side of the craft, said craft further comprising:

a battery;
electronic control module;
drives; and
remote communication device to control the self-propelled craft.

2. The self-propelled craft according to claim 1, characterized in that said craft has handles on tabs.

3. The self-propelled craft according to claim 1, characterized in that said craft comprises a sonar.

4. The self-propelled craft according to claim 1, characterized in that said craft comprises a GPS.

5. The self-propelled craft according to claim 1, characterized in that said craft comprises cameras.

6. The self-propelled craft according to claim 1, characterized in that drivers feeding the turbines are refrigerated with water and are in contact with the turbine operation chamber.

7. The self-propelled craft according to claim 1, characterized in that said craft comprises a battery with a connection for direct charging or a connection for induction charging.

8. The self-propelled craft according to claim 1, characterized in that the craft is made of an inflatable material.

9. The self-propelled craft according to claim 1, characterized in that said craft has a mechanical element which is configured to move in at least two possible positions, and at least one fluid detection device.

10. A self-propelled craft according to claim 1, said craft further comprising a distance communication device containing a turbine power controller and telemetry configured to indicate the battery level and allow a diagnosis of possible malfunctions, a consultation of charging cycles history and a monitoring of all telemetry functions.

* * * * *